US010337392B2

(12) United States Patent
Akiba et al.

(10) Patent No.: US 10,337,392 B2
(45) Date of Patent: Jul. 2, 2019

(54) MULTICYLINDER ENGINE COOLING APPARATUS

(71) Applicant: SUBARU CORPORATION, Tokyo (JP)

(72) Inventors: Shingo Akiba, Tokyo (JP); Yoshiyuki Shimizu, Tokyo (JP); Hirotake Nishina, Tokyo (JP); Hiroaki Mikami, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 56 days.

(21) Appl. No.: 15/798,685

(22) Filed: Oct. 31, 2017

(65) Prior Publication Data

US 2018/0149074 A1 May 31, 2018

(30) Foreign Application Priority Data

Nov. 30, 2016 (JP) ..... 2016-232840

(51) Int. Cl.
*F01P 7/14* (2006.01)
*F01P 7/16* (2006.01)
(Continued)

(52) U.S. Cl.
CPC ..... *F01P 7/165* (2013.01); *F01P 3/02* (2013.01); *F01P 3/14* (2013.01);
(Continued)

(58) Field of Classification Search
CPC ..... F01P 7/165; F01P 3/02; F01P 2025/32; F01P 2025/31; F01P 2003/028; F01P 3/14; F01P 2003/024; F01P 2007/146
See application file for complete search history.

(56) References Cited

U.S. PATENT DOCUMENTS 4,381,736 A * 5/1983 Hirayama ..... F01P 7/164 123/41.1
2002/0152979 A1* 10/2002 Hayashi ..... F01P 3/02 123/142.5 R
(Continued)

FOREIGN PATENT DOCUMENTS

JP H08-218873 8/1996
JP H08-226322 A 9/1996
(Continued)

OTHER PUBLICATIONS

Japanese Office Action dated Aug. 21, 2018 for JP Patent Application No. 2016-232840 (4 pages in Japanese with English translation).
(Continued)

*Primary Examiner* — Hung Q Nguyen
(74) *Attorney, Agent, or Firm* — Smith, Gambrell & Russell, LLP

(57) ABSTRACT

A multicylinder engine cooling apparatus includes: an exhaust side cooing passage individually formed to extend in an exhaust side of the cylinder head in which the plurality of exhaust pipes are disposed; an intake side cooling passage individually formed to extend in an intake side of the cylinder head in which the plurality of intake pipes are disposed; a first downstream cooling water passage through which the cooling water having passed through the exhaust side cooling passage flows; a second downstream cooling water passage that allows the cooling water having passed through the exhaust side cooling passage and then the intake side cooling passage to flow to the first downstream cooling water passage at some midpoint of the first downstream cooling water passage; and a switching valve that switches a flow passage of the cooling water discharged from the exhaust side cooling passage between the intake side cooling passage and the first downstream cooling water passage.

18 Claims, 4 Drawing Sheets

(51) Int. Cl.
*F01P 3/02* (2006.01)
*F01P 3/14* (2006.01)

(52) U.S. Cl.
CPC ... *F01P 2003/024* (2013.01); *F01P 2003/028* (2013.01); *F01P 2007/146* (2013.01); *F01P 2025/31* (2013.01); *F01P 2025/32* (2013.01)

(56) References Cited

U.S. PATENT DOCUMENTS

| | | | | |
|---|---|---|---|---|
| 2011/0197832 | A1* | 8/2011 | Berkemeier ..... | F02F 1/243<br>123/41.44 |
| 2013/0247848 | A1 | 9/2013 | Takahashi | |

FOREIGN PATENT DOCUMENTS

| | | | |
|---|---|---|---|
| JP | 2004-270652 | A | 9/2004 |
| JP | 2006-322333 | A | 11/2006 |
| WO | 2012/081081 | A1 | 6/2012 |

OTHER PUBLICATIONS

Decision to Grant a Patent dated Dec. 4, 2018 in Japanese Patent Application No. 2016-232840 (3 pages in Japanese with English Machine Translation).

* cited by examiner

MULTICYLINDER ENGINE COOLING APPARATUS

CROSS-REFERENCE TO RELATED APPLICATIONS

The present application claims priority from Japanese Patent Application No. 2016-232840 filed on Nov. 30, 2016, the entire contents of which are hereby incorporated by reference.

BACKGROUND

1. Technical Field

The present invention relates to an apparatus that cools a multicylinder engine.

2. Related Art

A multicylinder engine has an engine body including plurality of cylinders. The multicylinder engine is used as a power source of a vehicle such as an automobile. In the multicylinder engine, fuel and air are supplied to the cylinders, and fuel-air mixture is compressed and combusted so that a piston is pushed down, and therefore the multicylinder engine can provide power. The engine output can be increased and decreased by increasing and decreasing an amount of the fuel or the fuel-air mixture supplied to the cylinders. Here, heat is generated in this multicylinder engine by combusting the fuel or the fuel-air mixture in the cylinders. Therefore, the engine needs to be cooled by supplying cooling water to the engine. Japanese Unexamined Patent Application Publication (JP-A) No. H08-226322 discloses that a cooling passage through which cooling water flows is formed in the exhaust side of the cylinder block and the cylinder head of the engine body.

As described in JP-A No. H08-226322, it is possible to generate cooling water having a higher temperature when only the exhaust side of the cylinder head is cooled by the cooling water than, for example, when the intake side of the cylinder head is cooled as well as the exhaust side. By supplying this high-temperature cooling water to a heat collector such as a heat exchanger, it can be expected to improve the heat recovery rate. In this case, however, the cylinder head is heated not only in the exhaust side but also the intake side, and then heated in whole. As a result, when only the exhaust side of the cylinder head is cooled, the temperature of the intake side of the cylinder head may be gradually increased.

SUMMARY OF THE INVENTION

It is desirable to provide a multicylinder engine capable of achieving a high heat recovery rate while ensuring that the intake side is cooled.

An aspect of the present invention provides a multicylinder engine cooling apparatus configured to cool an engine by flowing cooling water through the engine, the engine including a cylinder head to which a plurality of pairs of intake pipes and exhaust pipes are coupled based on a layout of a plurality of cylinders. The multicylinder engine cooling apparatus includes: an exhaust side cooling passage individually formed to extend in an exhaust side of the cylinder head in which the plurality of exhaust pipes are disposed; an intake side cooling passage individually formed to extend in an intake side of the cylinder head in which the plurality of intake pipes are arranged; a first downstream cooling water passage through which the cooling water having passed through the exhaust side cooling passage flows; a second downstream cooling water passage that allows the cooling water having passed through the exhaust side cooling passage and then the intake side cooling passage to flow to the first downstream cooling water passage at a point between ends of the first downstream cooling water passage; and a switching valve configured to switch a flow passage of the cooling water discharged from the exhaust side cooling passage between the intake side cooling passage and the first downstream cooling water passage.

DETAILED DESCRIPTION

Hereinafter, an example of the present invention will be described with reference to the drawings.

Figure 1:
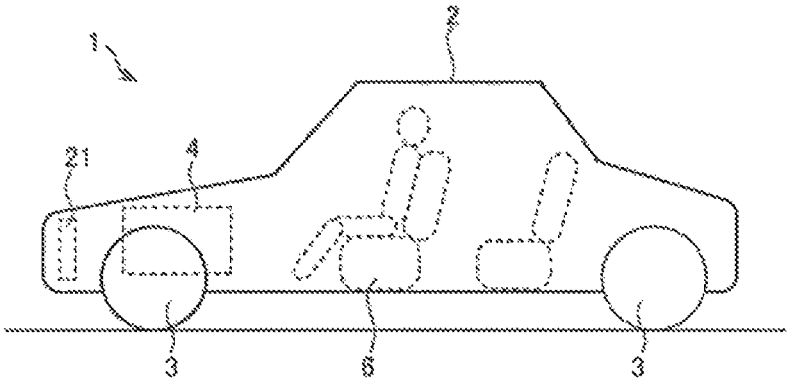
FIG. 1 illustrates an automobile using a multicylinder engine cooling apparatus according to an example of the present invention.

FIG. 1 illustrates an automobile 1 using a multicylinder engine cooling apparatus 20 according to the example of the present invention.

The automobile 1 illustrated in FIG. 1 includes an automobile body 2. Wheels 3 are disposed in both sides of the automobile body 2 in the width direction of the automobile body 2. In addition, a multicylinder engine 4, a radiator 21 and so forth are disposed in the front part of the automobile body 2. The automobile 1 is manually driven by a driver sitting on a seat 6 in a passenger compartment, or automatically driven under the control of an automatic driving device 52 according to a route created by a navigation device 51. During the manual driving, the automatic driving device 52 performs driving assist control.

Figure 2:
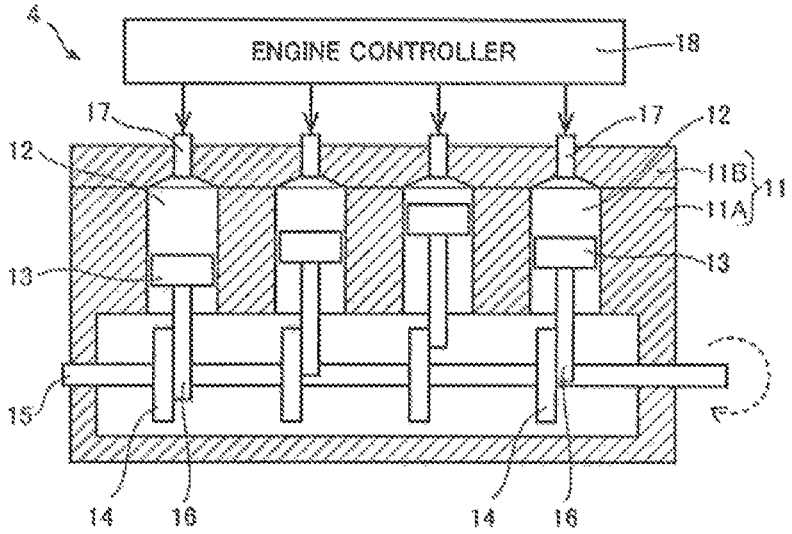
FIG. 2 is a longitudinal sectional view schematically illustrating the multicylinder engine illustrated in FIG. 1.

FIG. 2 is a longitudinal sectional view schematically illustrating the multicylinder engine 4 illustrated in FIG. 1. An engine controller 18 is illustrated in FIG. 2 as well as the multicylinder engine 4.

The multicylinder engine 4 illustrated in FIG. 2 includes an engine body 11 including a cylinder block 11A and a cylinder head 11B, four cylinders 12 arranged in a line in the cylinder block 11A, four pistons 13 disposed in the four cylinders 12, respectively, an output shaft 15 with four flywheels 14, and four connecting rods 16 that couple the pistons 13 to the flywheels 14, respectively. The cylinder head 11B is stacked on the cylinder block 11A to form combustion chambers in the heads of the cylinders 12. Injectors 17 are disposed in the cylinder head 11B such that the injectors 17 are exposed to the combustion chambers. In each of the cylinder 12, fuel-air mixture injected by the injector 17 is compressed by the piston 13 moving up and combusted by a plug (not shown), and then the piston 13 is pushed down by the pressure of the combustion gas. The force to push the pistons 13 down is transmitted through the connecting rods 16 and the flywheels 14 to rotate the output shaft 15. Basically, when an amount of the fuel injected from the injectors 17 is increased, the rotating torque and the rotating speed of the output shaft 15 are increased, and on the other hand, when the amount of the fuel injected from the injectors 17 is decreased, the rotating torque and the rotating speed of the output shaft 15 are decreased. The engine controller 18 controls the amount of the fuel injected from the injectors 17 to control the engine output. In addition, the engine controller 18 may cause the four injectors 17 to it not only the same but also different amounts of the fuel. To be more specific, for example, the engine controller 18 causes part of the four injectors 17 to inject the fuel while stopping the remaining injectors 17 from injecting the fuel. By this means, it is possible to reduce the total amount of fuel injection to improve the fuel efficiency. The cylinder 12 having the injector 17 which does not inject the fuel is placed in an idle state where the fuel is not combusted. On the other hand, the cylinder 12 having the injector 17 which injects the fuel is placed in a continuous working state where the fuel is combusted.

This multicylinder engine 4 can generate cooling water having a higher temperature when only the exhaust side of the cylinder heads 11B is cooled than, for example, when the intake side of the cylinder head 11B is cooled as well as the exhaust side. By supplying this high-temperature cooling water to a heat collector such as the heat exchanger 26, it can be expected to improve the heat recovery rate. In this case, however, the cylinder head 11B is heated not only in the exhaust side but also the intake side, and then heated in whole. As a result, when only the exhaust side of the cylinder head 11B is cooled, the temperature of the intake side of the cylinder head 11B may be gradually increased. Thus, it is desirable that the multicylinder engine 4 achieve a high heat recovery rate while ensuring that the intake side is cooled.

Figure 3:
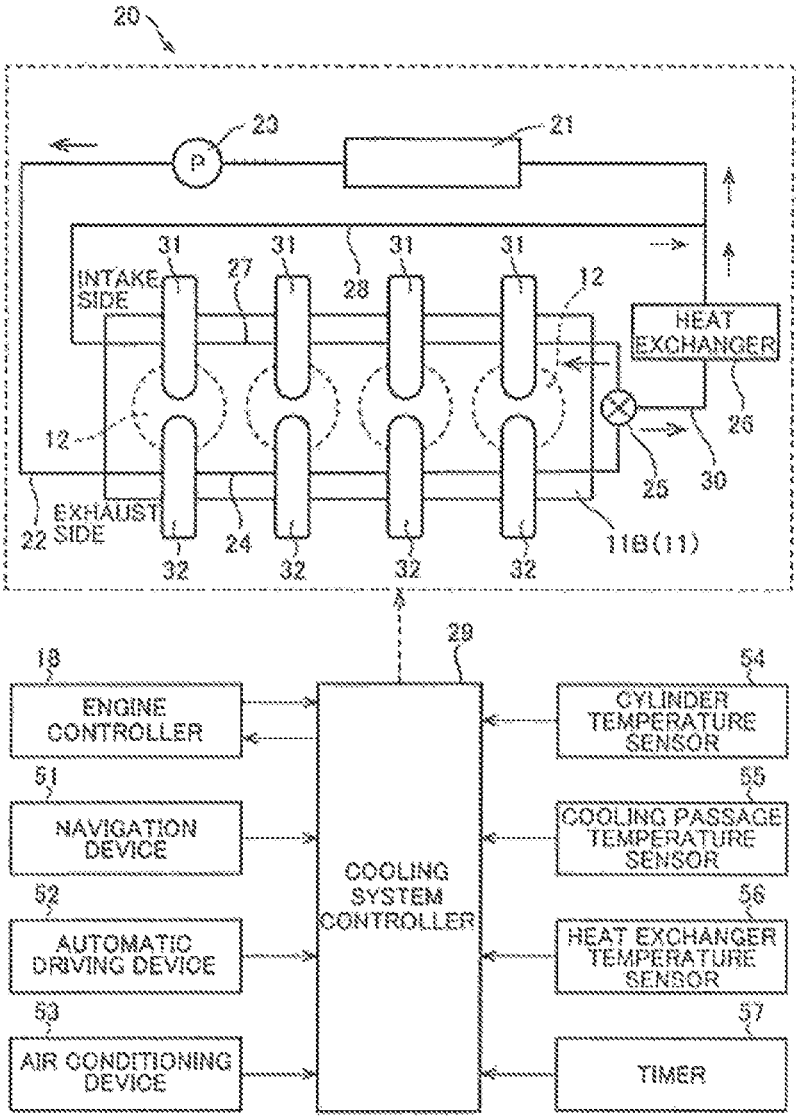
FIG. 3 is illustrates the configuration of the multicylinder engine cooling apparatus according to the example of the present invention.

FIG. 3 illustrates the configuration of the multicylinder engine cooling apparatus 20 according to the example of the present invention.

The multicylinder engine cooling apparatus 20 is intended to cool the engine body 11 including the plurality of cylinders 12, in particular, to cool the cylinder head 11B. The cylinder head 11B of the engine body 11 is illustrated in FIG. 3. A plurality of pairs of intake pipes 31 and exhaust pipes 32 are coupled to the cylinder head 11B based on the layout of the plurality of cylinders 12. The multicylinder engine cooling apparatus 20 includes a radiator 21, a upstream cooling water passage 22, a pump 23, an exhaust side cooling passage 24, a switching valve 25, the heat exchanger 26, an intake side cooling passage 27, a second downstream cooling water passage 28, a cooling system controller 29, and a first downstream cooling water passage 30.

As shown in FIG. 1, the radiator 21 is disposed in the forefront of the automobile body 2. The radiator 21 cools cooling water by the outside air.

The upstream cooling water passage 22 couples the radiator 21 to the engine body 11. The pump 23 is provided on the upstream cooling water passage 22 and supplies the cooling water in the radiator 21 to the engine body 11.

The exhaust side cooling passage 24 and the intake side cooling passage 27 extend along the direction in which the plurality of cylinders 12 are arranged in the cylinder head 11B of the engine body 11. The exhaust side cooling passage 24 is formed in the cylinder head 11B on the side of the plurality of exhaust pipes 32. Meanwhile, the intake side cooling passage 27 is formed in the cylinder head 11B on the side of the plurality of intake pipes 31. Here, although the exhaust side cooling passage 24 and the intake side cooling passage 27 are indicated by lines in the drawing, each of them may have an appropriate width in accordance with its structure in the cylinder head 11B in reality. Moreover, although the exhaust side cooling passage 24 and the intake side cooling passage 27 penetrate the cylinder head 11B and are completely individual lines as illustrated in the drawing, they may be coupled to one another at the end of the cylinder head 11B. For example, when the switching valve 25 is built in the cylinder head 11B, part of the flow passage from the switching valve 25 to the heat exchanger 26 is formed in the cylinder head 11B. In this case, the exhaust side cooling passage 24 and the intake side cooling passage 27 are coupled to one another at the end of the cylinder head 11B.

The switching valve 25 switches the destination into which the cooling water flows.

The heat exchanger 26 collects the heat from the cooling water.

The upstream cooling water passage 22 is coupled to one end of the exhaust side cooling passage 24. The switching valve 25 is coupled to the other end of the exhaust side cooling passage 24. In addition, one end of the intake side cooling passage 27 and one end of the first downstream cooling water passage 30 are coupled to the switching valve 25. The heat exchanger 26 is provided in the first downstream cooling water passage 30. The other end of the first downstream cooling water passage 30 is coupled to the radiator 21. By this means, a circulation route for which the cooling water that has cooled only the exhaust side of the cylinder head 11B flows to the heat exchanger 26 is formed. The action of the pump 23 allows the cooling water to flow from the upstream cooling water passage 22 to the exhaust side cooling passage 24, to the switching valve 25, to the first downstream cooling water passage 30, and to the heat exchanger 26 in sequence, and return to the radiator 21. Moreover, one end of the second downstream cooling water passage 28 is coupled to the other end of the intake side cooling passage 27. The other end of the second downstream cooling water passage 28 is coupled to the first downstream cooling water passage 30 at some midpoint between the ends of the first downstream cooling water passage 30. The second downstream cooling water passage 28 is coupled to the first downstream cooling water passage 30 in the downstream of the heat exchanger 26. By this means, a circulation route for which the cooling water flows to the exhaust side and the intake side of the cylinder head 11B is formed. The action of the pump 23 allows the cooling water 23 to flow from the upstream cooling water passage 22, to the exhaust side cooling passage 24, to the switching valve 25, to the intake side cooling passage 27, to the second downstream cooling water passage 28, and to the first downstream cooling water passage 30 in sequence, and return to the radiator 21.

The engine controller 18, the navigation device 51, the automatic driving device 52, an air conditioning device 53 that heats or cools the passenger compartment, cylinder temperature sensors 54, cooling passage temperature sensors 55, a heat exchanger temperature sensor 56 and a timer 57 are coupled to the cooling system controller 29. The cooling system controller 29 controls the circulation of the cooling water in the circulation route based on information from each of the above-described components. For example, the cooling system controller 29 controls the switching of the switching valve 25.

The cylinder temperature sensors 54 are disposed near the respective cylinders 12 in the engine body 11 of the multicylinder engine 4. By this means, the cylinder temperature sensors 54 detect the temperatures of the cylinders 12, respectively.

The cooling passage temperature sensors 55 are provided, for example, in the exhaust side cooling passage 24 and the intake side cooling passage 27. By this means, the cooling passage temperature sensors 55 detect the temperatures of the cooling water flowing through the exhaust side cooling passage 24 and the intake side cooling passage 27.

The heat exchanger temperature sensor 56 is provided in the heat exchanger 26. By this means, the heat exchanger temperature sensor 56 detects, for example, the temperature of a heat medium in the heat exchanger 26, or the temperature of the cooling water that has flowed through the heat exchanger 26.

The timer 57 measures time such as an elapsed time.

Figure 4:
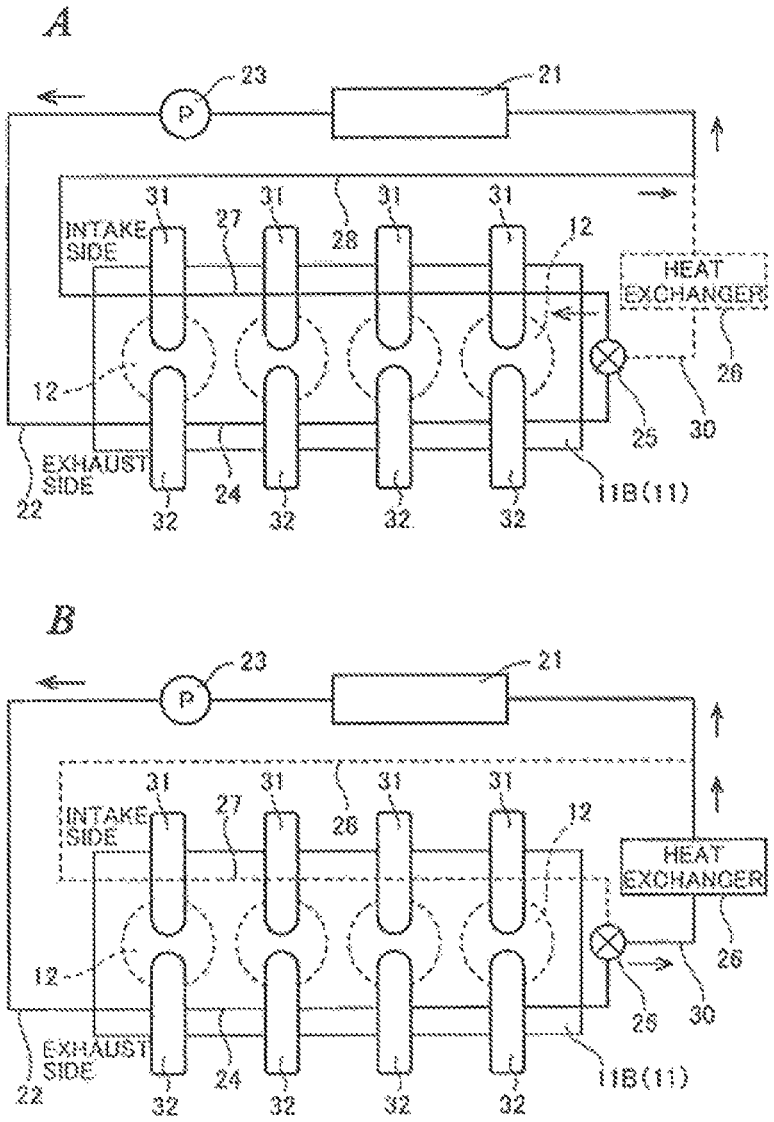
FIG. 4 is illustrates switching control for a circulation route of cooling water.

FIG. 4 illustrates the switching control for the circulation route of the cooling water. The cooling system controller 29 performs the switching control for the circulation route of the cooling water, based on information from the engine controller 18 and so forth.

For example, in the cold state just after the multicylinder engine 4 is activated, it is preferred that the intake side of the cylinder head 11B is warmed. In this case, the cooling system controller 29 causes the switching valve 25 to select the intake side cooling passage 27 as illustrated in FIG. 4A. The switching valve 25 opens the flow passage to the intake side cooling passage 27, and closes the flow passage to the first downstream cooling water passage 30.

The action of the pump 23 allows the cooling water to flow from the exhaust side cooling passage 24, to the switching valve 25, to the intake side cooling passage 27, and to the second downstream cooling water passage 28 in sequence, and be supplied to the radiator 21. The cooling water flows through both the exhaust side and the intake side of the cylinder head 11B of the engine body 11. The cooling water warmed by the heat in the exhaust side of the cylinder head 11B flows through the intake side of the cylinder head 11B, and therefore can warm the intake side of the cylinder head 11B. In addition, the cooling water warmed by cooling the cylinder head 11B is returned to the radiator 21 via the second downstream cooling water passage 28. Further, for example, when the multicylinder engine 4 is normally operated, it is preferred that the cooling system controller 29 performs the switching control as illustrated in FIG. 4A to cool the intake side of the cylinder head 11B. During the normal operation of the multicylinder engine 4, both the exhaust side at a relatively high temperature and the intake side at a relatively low temperature are cooled depending on the respective temperatures, and therefore it is possible to efficiently cool the engine body 11.

When the temperature of the passenger compartment is low during the cold season, it is preferred that the passenger compartment is warmed as soon as possible. Moreover, even in the cold state just after the multicylinder engine 4 is activated, it is preferred that the high-temperature cooling water is supplied to the heat exchanger 26 to operate the heat exchanger 26 at a high heat recovery rate. In this case, the cooling system controller 29 causes the switching valve 25 to select the heat exchanger 26 as illustrated in FIG. 4B. The switching valve 25 opens the flow passage to the first downstream cooling water passage 30, and closes the flow passage to the intake side cooling passage 27. The action of the pump 23 allows the cooling water to flow from the exhaust side cooling passage 24, to the switching valve 25, and to the heat exchanger 26 on the first downstream cooling water passage 30 in sequence, and be supplied to the radiator 21. The cooling water flows through only the exhaust side of the cylinder head 11B of the engine body 11. The cooling water warmed by the heat only in the exhaust side of the cylinder head 11B is supplied directly to the heat exchanger 26. Here, part of the heat of the cooling water is collected in the heat exchanger 26, and then the cooling water is returned to the radiator 21. By this means, the cooling water which has just been warmed by passing through the exhaust side cooling passage 24 can be supplied to the heat exchanger 26, without passing through the intake side which has little need to be cooled. The heat exchanger 26 can efficiently collect necessary heat from the high-temperature cooling water. Further, for example, when the multicylinder engine 4 is subjected to a high load even though being warmed and normally operated, it is preferred that the cooling water is supplied from the switching valve 25 to the heat exchanger 26. By this means, it is possible to prevent part of the heat of the cooling water heated to a significantly high temperature by the engine body 11 under the high load condition from returning to the engine body 11.

As described above, with this example, the exhaust side cooling passage 24 and the intake side cooling passage 27 are individually formed in the exhaust side and the intake side of the cylinder head 11B, respectively. The circulation route of the cooling water includes the first downstream cooling water passage 30 through which the cooling water having passed through the exhaust side cooling passage 24 flows to circulate in the circulation route, and the second downstream cooling water passage 28 that allows the cooling water having passed through the exhaust side cooling passage 24 and then the intake side cooling passage 27 to flow to the midpoint of the first downstream cooling water passage 30. The switching valve 25 switches the flow passage of the cooling water discharged from the exhaust side cooling passage 24 between the intake side cooling passage 27 and the first downstream cooling water passage 30. Thus, the flow passage of the cooling water discharged from the exhaust side cooling passage 24 is switched to the intake side cooling passage 27, and therefore the cooling water can flow to the intake side of the cylinder head 11B. As a result, it is possible to cool the intake side of the cylinder head 11B. The cylinder head 11B is cooled both in the exhaust side and the intake side, and therefore it is possible to balance the heat of the cylinder head 11B between the exhaust side and the intake side. Moreover, the flow passage of the cooling water discharged from the exhaust side cooling passage 24 is switched to the first downstream cooling water passage 30, and therefore the cooling water having a high temperature by cooling only the exhaust side as the high-temperature side of the cylinder head 11B can be flowed to the first downstream cooling water passage 30. Then, the heat collector such as the heat exchanger 26 provided in the first downstream cooling water passage 30 can efficiently collect heat from the high-temperature cooling water.

With this example, just after the multicylinder engine 4 is activated, the cooling system controller 29 switches the switching valve 25 such that the cooling water discharged from the exhaust side cooling passage 24 flows to the intake side cooling passage 27. Therefore, it is possible to efficiently warm the whole cylinder head 11B just after the multicylinder engine 4 is activated.

With this example, the heat exchanger 26 is provided in the first downstream cooling water passage 30, and the second downstream cooling water passage 28 is coupled to the first downstream cooling water passage 30 in the downstream of the heat exchanger 26 so as to bypass the heat exchanger 26. Therefore, the high-temperature cooling water warmed by the heat in the exhaust side can be supplied to the heat exchanger 26. As a result, it is possible to improve the heat exchanger effectiveness of the heat exchanger 26.

In addition, with this example, when a heat exchange is required in the cold state just after the multicylinder engine 4 is activated, the switching valve 25 is switched such that the cooling water discharged from the exhaust side cooling passage 24 flows to the first downstream cooling water passage 30. Therefore, even in the cold state just after the multicylinder engine 4 is activated, it is possible to supply the high-temperature cooling water to the heat exchanger 26, and consequently to efficiently perform a heat exchange.

Moreover, with this example, during the normal operation of the multicylinder engine 4, the switching valve 25 is switched such that the cooling water discharged from the exhaust side cooling passage 24 flows to the intake side cooling passage 27. Therefore, during the normal operation of the engine, both the exhaust side at a relatively high temperature and the intake side at a relatively low temperature are cooled depending on how high or low the temperatures are. As a result, it is possible to efficiently cool the engine body 11.

While the above-described example is one of preferred examples of the present invention, it is to be understood that the invention is not limited to the example. The present invention is intended to cover various modification and alteration without departing from the spirit and scope of the present invention.

With the above-described example, the exhaust side cooling passage 24, the intake side cooling passage 27, and the first downstream cooling water passage 30 are coupled to the switching valve 25. In addition, for example, the switching valve 25 may be provided in the downstream of the illustrated position, that is, provided at some midpoint of the flow passage formed by the intake side cooling passage 27 and the second downstream cooling water passage 28. In this case, it is also possible to switch the flow passage in the same way as the above-described example.

The invention claimed is:

1. A multicylinder engine cooling apparatus configured to cool an engine by flowing cooling water through the engine, the engine comprising a cylinder head to which a plurality of pairs of intake pipes and exhaust pipes are coupled based on a layout of a plurality of cylinders, the multicylinder engine cooling apparatus comprising:

an exhaust side cooling passage individually formed to extend in an exhaust side of the cylinder head in which the plurality of exhaust pipes are disposed;

an intake side cooling passage individually formed to extend in an intake side of the cylinder head in which the plurality of intake pipes are disposed;

a first downstream cooling water passage through which the cooling water having passed through the exhaust side cooling passage flows without passing through the intake side cooling passage;

a second downstream cooling water passage that allows the cooling water having passed through the exhaust side cooling passage and then the intake side cooling passage to flow to the first downstream cooling water passage at a point between ends of the first downstream cooling water passage; and a switching valve configured to switch a flow passage of the cooling water discharged from the exhaust side cooling passage between the intake side cooling passage and the first downstream cooling water passage.

2. The multicylinder engine cooling apparatus according to claim 1, further comprising a heat collector provided in the first downstream cooling water passage, wherein the second downstream cooling water passage is coupled to the first downstream cooling water passage in a downstream of the heat collector so as to bypass the heat collector.

3. The multicylinder engine cooling apparatus according to claim 2, further comprising a controller configured to control circulation of the cooling water, wherein just after the engine is activated, the controller switches the switching valve such that the cooling water discharged from the exhaust side cooling passage flows to the intake side cooling passage.

4. The multicylinder engine cooling apparatus according to claim 2, wherein when a heat exchange is required in a cold state just after the engine is activated, the controller switches the switching valve such that the cooling water discharged from the exhaust side cooling passage flows to the first downstream cooling water passage to supply the cooling water to the heat collector.

5. The multicylinder engine cooling apparatus according to claim 3, wherein when a heat exchange is required in a cold state just after the engine is activated, the controller switches the switching valve such that the cooling water discharged from the exhaust side cooling passage flows to the first downstream cooling water passage to supply the cooling water to the heat collector.

6. The multicylinder engine cooling apparatus according to claim 2, wherein when the engine is subjected to a high load, the controller switches the switching valve such that the cooling water discharged from the exhaust side cooling passage flows to the first downstream cooling water passage.

7. The multicylinder engine cooling apparatus according to claim 3, wherein when the engine is subjected to a high load, the controller switches the switching valve such that the cooling water discharged from the exhaust side cooling passage flows to the first downstream cooling water passage.

8. The multicylinder engine cooling apparatus according to claim 4, wherein when the engine is subjected to a high load, the controller switches the switching valve such that the cooling water discharged from the exhaust side cooling passage flows to the first downstream cooling water passage.

9. The multicylinder engine cooling apparatus according to claim 5, wherein when the engine is subjected to a high load, the controller switches the switching valve such that the cooling water discharged from the exhaust side cooling passage flows to the first downstream cooling water passage.

10. The multicylinder engine cooling apparatus according to claim 1, wherein the exhaust side cooling passage, the intake side cooling passage, and the first downstream cooling water passage are coupled to the switching valve.

11. The multicylinder engine cooling apparatus according to claim 2, wherein the exhaust side cooling passage, the intake side cooling passage, and the first downstream cooling water passage are coupled to the switching valve.

12. The multicylinder engine cooling apparatus according to claim 3, wherein the exhaust side cooling passage, the intake side cooling passage, and the first downstream cooling water passage are coupled to the switching valve.

13. The multicylinder engine cooling apparatus according to claim 4, wherein the exhaust side cooling passage, the intake side cooling passage, and the first downstream cooling water passage are coupled to the switching valve.

14. The multicylinder engine cooling apparatus according to claim 5, wherein the exhaust side cooling passage, the intake side cooling passage, and the first downstream cooling water passage are coupled to the switching valve.

15. The multicylinder engine cooling apparatus according to claim 6, wherein the exhaust side cooling passage, the intake side cooling passage, and the first downstream cooling water passage are coupled to the switching valve.

16. The multicylinder engine cooling apparatus according to claim 7, wherein the exhaust side cooling passage, the intake side cooling passage, and the first downstream cooling water passage are coupled to the switching valve.

17. The multicylinder engine cooling apparatus according to claim 8, wherein the exhaust side cooling passage, the intake side cooling passage, and the first downstream cooling water passage are coupled to the switching valve.

18. The multicylinder engine cooling apparatus according to claim 9, wherein the exhaust side cooling passage, the intake side cooling passage, and the first downstream cooling water passage are coupled to the switching valve.

* * * * *